United States Patent [19]

Sakamoto et al.

[11] Patent Number: 5,062,809

[45] Date of Patent: Nov. 5, 1991

[54] HIGH-FREQUENCY CONNECTOR AND METHOD OF MANUFACTURING THEREOF

[75] Inventors: Katsuhiko Sakamoto, Kamakura; Akira Kawaguchi, Musashi-murayama; Yasuhiro Ishikawa, Machida, all of Japan

[73] Assignee: AMP Incorporated, Harrisburg, Pa.

[21] Appl. No.: 669,802

[22] Filed: Mar. 15, 1991

[30] Foreign Application Priority Data

Mar. 15, 1990 [JP] Japan ..... 2-62763

[51] Int. Cl.[5] ..... H01R 13/54

[52] U.S. Cl. ..... 439/581

[58] Field of Search ..... 439/578–585, 439/607–610

[56] References Cited

U.S. PATENT DOCUMENTS

| | | | |
|---|---|---|---|
| 3,356,800 | 12/1967 | Bailey et al. | 439/578 |
| 3,503,035 | 3/1970 | Lazar et al. | 439/578 |
| 3,824,528 | 7/1974 | Esser | 439/578 |

*Primary Examiner*—Joseph H. McGlynn

*Attorney, Agent, or Firm*—Allan B. Osborne; Adrian J. LaRue

[57] ABSTRACT

An electrical connector comprises outer plate-shaped contacts and a center plate-shaped contact, a dielectric member is secured onto the plate-shaped contacts maintaining the plate-shaped contacts in spaced relationship and in the same plane so that the plate-shaped contacts are coplanar, a coupling part at the other ends of the outer plate-shaped contacts interconnecting them, a receptacle contact as part of the coupling part, and a pin contact member at the other end of the center plate-shaped contact disposed within the receptacle contact member at the center thereof.

8 Claims, 5 Drawing Sheets

HIGH-FREQUENCY CONNECTOR AND METHOD OF MANUFACTURING THEREOF

FIELD OF THE INVENTION

The present invention relates to a high-frequency connector and in particular to a connector which can be applied for a high-frequency signal transmission path for high-frequency semi-conductor device tester and other DC through GHz equipment and to a method for manufacturing it.

BACKGROUND OF THE INVENTION

Coplanar transmission lines which make use of coaxial cables or parallel arrayed signal conductors and ground conductors are widely used for high-frequency signal transmission lines which transmit high-frequency signals with minimum attenuation.

These high-frequency signal lines are used selectively either to connector or to disconnect the signal lines. For example, in the performance characteristic evaluation device for semi-conductors which is known as the "IC tester" or "wafer prober", a great number of high-frequency signal paths are required to supply test signals to multiple test points of semiconductor devices and to receive them as well. In this type of device, a great number of test boards are provided depending on the dimensions, shape and in particular, the pin array and the number of devices being tested, coupled with the fact that the test device itself must be switched depending on the device being tested. It is effective in that when a great number of high-frequency connectors are used at this time, the time consumed for such operations as soldering is reduced which explains its popularity.

When the device being tested puts out more high-frequency signals and high performance, the connector being used naturally must put out more high-frequency signals and higher performance. If it does not, the device being tested cannot be relied on to produce accurate performance results and the reliability of the test itself is adversely affected.

A high-frequency signal connector which is used for these objectives is described in Japanese Patent Publication No. 51-44757. In this conventional electrical connector, the end of the coaxial cable is stripped so that the center signal conductor is exposed at a certain length of several mm. The braided outer conductor is folded backward and metallic sleeve is secured thereover. Next, a small socket pin is soldered to the signal conductor on the strip line which is formed on the circuit substrate. At the same time, legs of a resilient cylindrical ground socket are soldered and connected to the strip line ground conductor, the socket is set in place over the socket pin. A coaxial cable which has been stripped is inserted and connected to the socket pin and the ground socket.

The above-mentioned coaxial connector makes it possible to connect high-frequency signals to the strip line on the circuit substrate from the coaxial cable using the discontinuity of the minimum characteristic impedance. However, this was found to be defective in that a comparatively long socket pin and cylindrical ground socket were required so that miniaturization, in particular several hundreds of coaxial cables, could not be formed in a high density manner. In addition, a certain degree of discontinuity of the characteristic impedance due to the socket pin was unavoidable.

Therefore, it is an object of the present invention to provide a high-frequency connector which is capable of small-scale, high-density formation using the discontinuity of the minimum characteristic impedance on the strip line from the coaxial cable and a method for manufacturing this high-frequency connector.

SUMMARY OF THE INVENTION

When the high-frequency connector of the present invention is used, a signal conductor is disposed between parallel ground conductors, and a strip line, that is to say, a coplanar transmission line, is formed. At the same time, the ends of both ground conductors are bent and connected to each other and formed to make a cylindrical member and the end of the signal conductor is inserted in the center thereof. The above-mentioned end of the ground and signal conductors which are parallel to each other must be stabilized using a dielectric block. A very thin coaxial cable, for example, a coaxial cable which has been processed as described in Japanese Published Utility Model No. 62-66187 and Japanese Published Utility Model No. 1-140572, is selectively inserted in a coaxial receptacle which has been formed so that it is coaxial.

When the method for manufacturing the high-frequency coaxial connector in the present invention is used, the following type of coaxial connector is obtained: a coupling part of a ground contact shaped like the letter "U" on its side is folded to form a cylindrical ground receptacle surrounding the front end of a signal contact which is disposed at the center of the receptacle. The free ends of these ground contacts and signal contact are fixed with a dielectric block forming a coplanar transmission line and the other ends forming a coaxial receptacle.

This high-frequency connector is manufactured by cutting out a conductive metal plate which has been coupled to a carrier strip and forming it so that multiple connectors are contiguous to each other. The ground contact part and the signal contact part may be made from separate metal plates or they may be made by folding and forming a single metal plate.

The high-frequency connector which is configured in this way may be inserted and fixed in an insulated housing which is equipped with multiple recessed parts and makes possible modularization of any number of high-frequency connectors.

BRIEF DESCRIPTION OF THE DRAWINGS

The attached drawings illustrate practical examples and the following description discloses in detail the high-frequency connector of the present invention as well as the method for manufacturing this high-frequency connector.

DETAILED DESCRIPTION OF THE INVENTION

Figure 1:
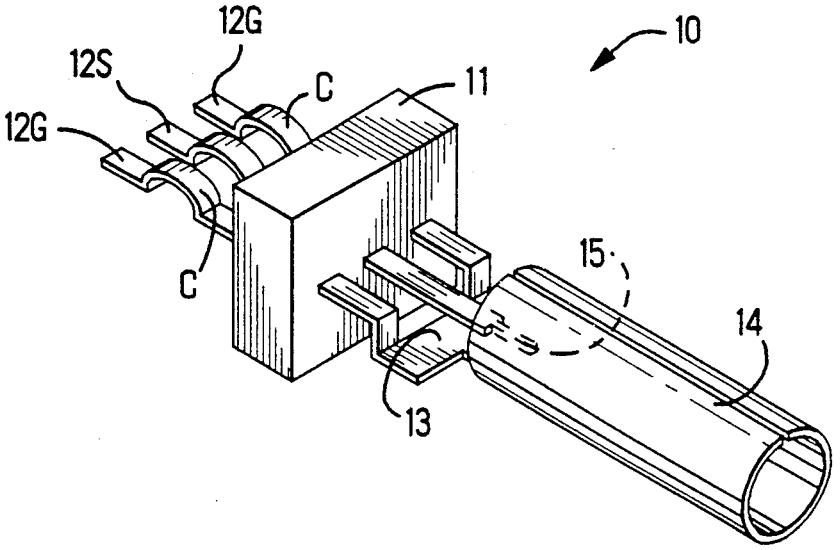
FIG. 1 is a perspective view of the high-frequency connector showing a suitable practical example of the present invention.

As can be seen from FIG. 1, high-frequency connector 10, which is based on a specific example of this invention, is fixed at the center by dielectric block 11 and is equipped with three parallel plate-shaped contacts 12 which are equipped with arcuate contact sections C. The two outer plate-shaped contacts are ground contacts 12G. The center plate-shaped contact is a signal contact 12S. These plate-shaped contacts 12 should be retained steadfastly at specific intervals and the commonly-known coplanar or strip line-type signal transmission line is formed thereby. The characteristic impedance is determined by the width of the individual contacts, spaces between the centers and the dielectric medium between them which was selected at 50 Ohms in the specific practical example.

The other end of the plate-shaped contacts 12 protrudes slightly from dielectric block 11. Ground contacts 12G are folded downwardly and are mutually coupled with coupling part 13 which includes an outer section formed into a cylindrical receptacle 14. The cross-section by no means need be circular, but may be elliptical or may comprise other polygonal shapes. By no means must it be of a particular shape along its entire length and should be seen as a commonly-known connector receptacle of any shape which may be equipped with slits or slots along its circumference. On the other hand, the other end of the signal contact 12S is shaped like a small circular pin and is disposed at the center of cylindrical ground receptacle 14 as a center signal contact pin 15. The coaxial receptacle connector is made up of ground receptacle 14 and center contact pin 15.

Figure 2:
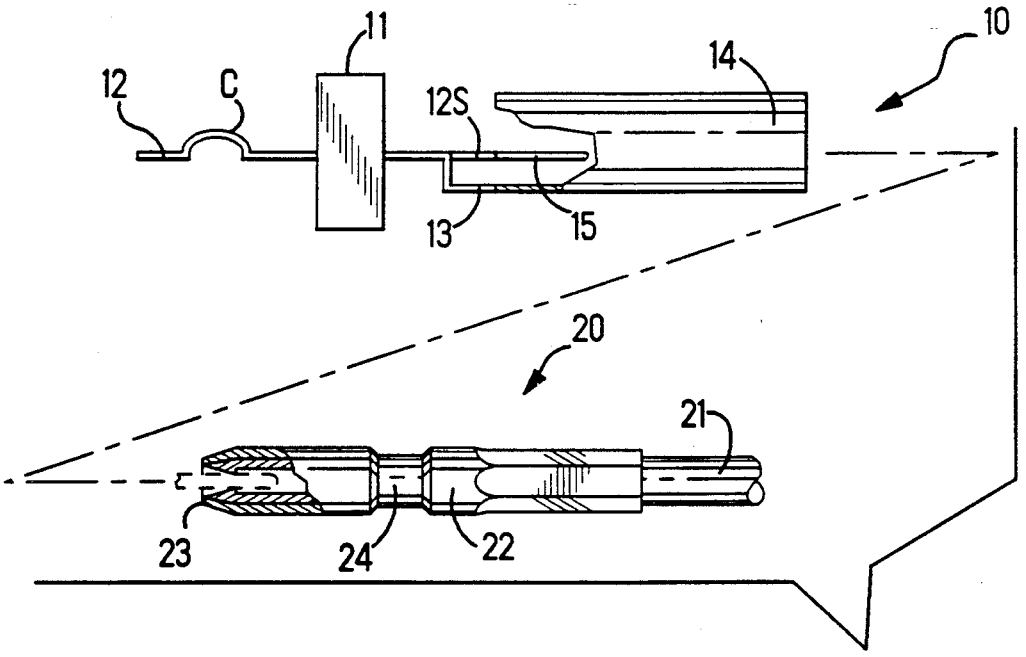
FIG. 2 is a side view of the high-frequency connector illustrated in FIG. 1 and the coaxial connector to be connected to it.

FIG. 2 is a side view of high-frequency connector 10 of the present invention before it is connected with coaxial connector 20 which is connected to coaxial cable 21. As can be seen from FIG. 2, each of the plate-shaped contacts 12 are formed in a plane in the same way as the contact sections C and make contact on a level surface. The spaces between the signal contact 12S and the back end of ground receptacle 14 are shaped so that they are as narrow as possible and maintain the coupling part 13 of ground contacts 12G and the spaces uniform. As a result, the characteristic impedance can be understood to be maintained at indicated values (for example, 50 Ohms) over the entire surface of the signal contact 12S. It is relatively easy to see that the discontinuity of the characteristic impedance caused by the material of dielectric block 11 can be completely eliminated by changing in advance the range or the spacing of the plate-shaped contacts 12 on the block based on computed values.

Coaxial connector 20 which is inserted and connected to the coaxial receptacle part of high-frequency connector 10 is connected to an extremely fine coaxial cable 21 of approximately 1 mm which is equipped with a characteristic impedance of preferably 50 Ohms and is configured of a socket shaped center contact (not shown in the figure) and exposed outer contact 22 which is concentric with the center contact by means of commonly-known connector manufacturing practices. This outer contact 22 maintains the outer braided conductor of coaxial cable 21 onto the insulated jacket of cable 21 by crimping outer contact 22 so that the outside diameter is approximately 1.5 mm. Taper 23 is formed on the front end and is easily inserted into receptacle 14. At the same time, a depressed section 24 is formed in outer contact 22 and functions for retaining connector 20 in receptacle 14.

Next, the method for manufacturing the high-frequency connector 10 in the present invention is described by referring to FIGS. 3 A–E. FIG. 3A shows ground contact assemblies 30 which are mutually connected to carrier strip 31 which comprises multiple ground contacts and ground receptacles which have been stamped and formed out of conductive metal. This carrier strip 31 is equipped with feed holes 32 at specific intervals. Each of the individual ground contact assemblies 30 is equipped with a pair of parallel plate-shaped ground contacts 12G which include contact sections C, coupling part 13 folded at one of the ends of the plate-shaped ground contacts and cylindrical receptacle 14. Both plate-shaped ground contact 12G and coupling part 13 have a part which is shaped like the letter "U" turned on its side. The holes 32 may be made so that they are formed on the intermediate parts of plate-shaped ground contacts 12G of each of the ground contact assemblies 30. These assemblies 30 can be formed by using the commonly-known stamping and forming techniques from a conductive metal plate so that there is no need to go into a detailed description of such techniques.

Figure 3A:
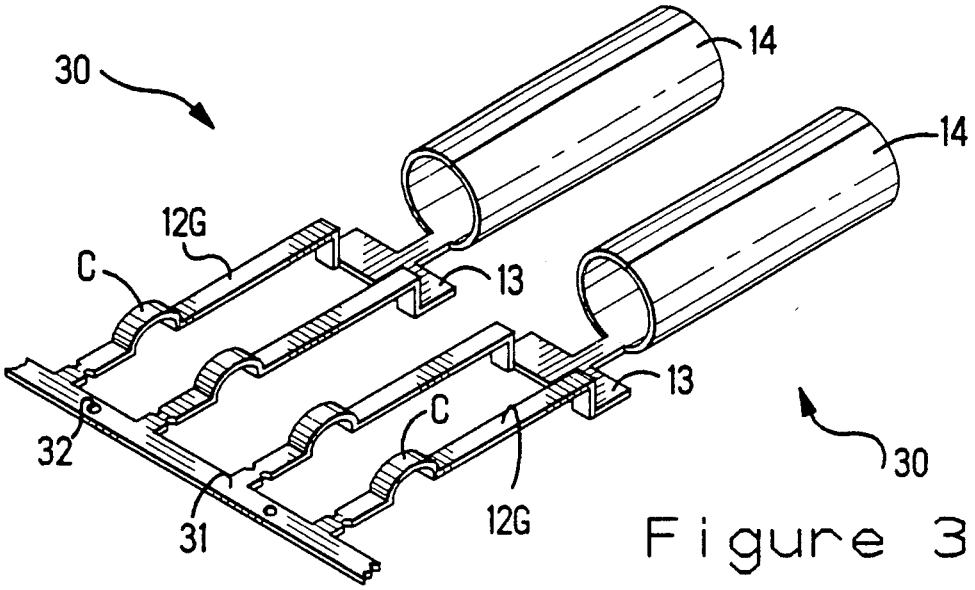
FIGS. 3A–E are perspective views showing the procedures involved in manufacturing the high-frequency connector of the present invention.
Figure 3B:
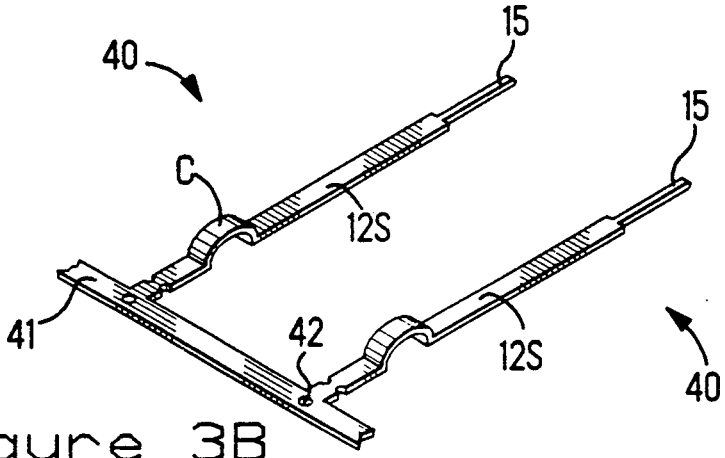

FIG. 3B shows signal contact assemblies 40. Multiple plate-shaped signal contacts 12S, which comprise connection sections C and center signal contact pin 15 are formed by being part of carrier strip 41. Feed holes 42 are formed in the carrier strip 41, for example, at the fixed positions of the individual signal contact assemblies 40.

Figure 3C:
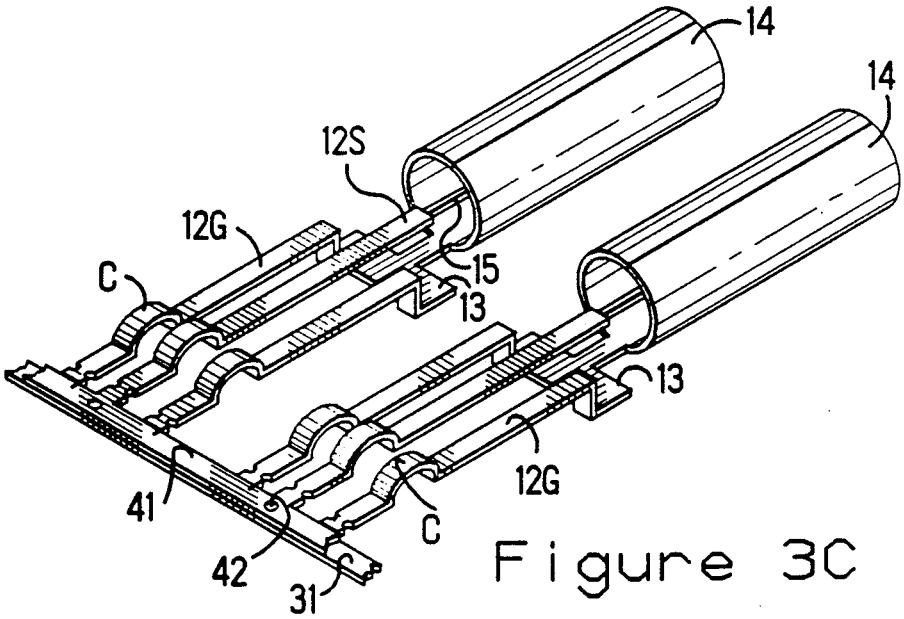

Next, both carrier strips 31 and 41 in FIGS. 3A and 3B are superposed based on holes 32 and 42 and so that assemblies 30 and 40 are interlocked as indicated in FIG. 3C. Special pains should be taken this time to make certain that the carrier strip 41 of signal contact assemblies 40 is moved horizontally or parallel to carrier strip 31 of ground contact assemblies 30 so that center signal contact pins 15 are properly inserted in ground receptacles 14. An elevated surface should be formed on carrier strips 31 and 41 and plate-shaped signal contacts 12S and one side or both sides of the coupling parts of plate-shaped ground contacts 12G so that each of the plate-shaped contacts 12 shares a common flat surface.

Figure 3D:
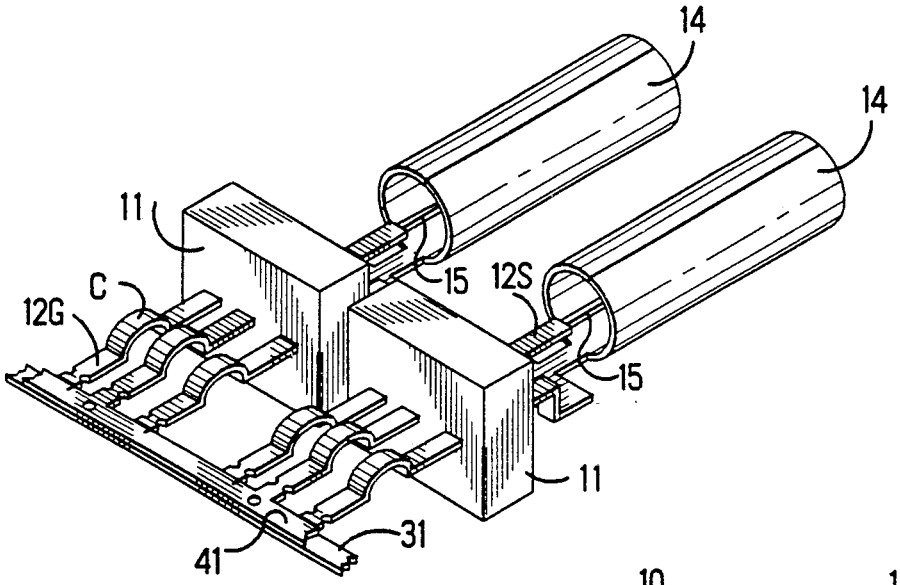
Figure 3E:
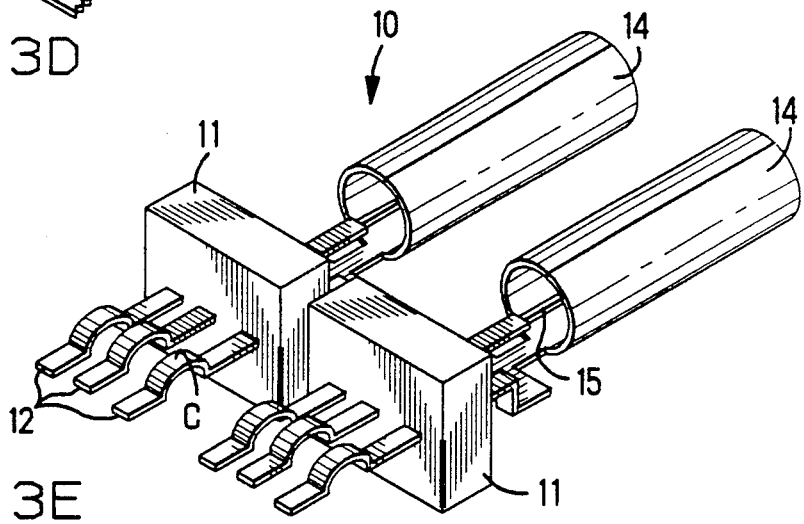

Next, dielectric blocks 11 using polyphenylene sulfide or similar material are insert-molded near one of the ends of each of the plate-shaped contacts 12 as shown in FIG. 3D. Then, each of the plate-shaped contacts 12 is cut from carrier strips 31 and 41 using a cutter, as is shown in FIG. 3E, so that the high-frequency connectors 10 of the present invention are completed, as shown in FIG. 1. As can be readily seen, this high-frequency connector 10 can be manufactured progressively and continuously using a series of procedures as shown by FIGS. 3A–E.

FIGS. 4A–E show the procedures involved in another method of manufacturing the high-frequency connector 10 of the present invention. This method of manufacturing takes into account the efficiency of the material used by forming the ground contact part and the signal contact part from a single metal plate, thereby reducing manufacturing costs.

Figure 4A:
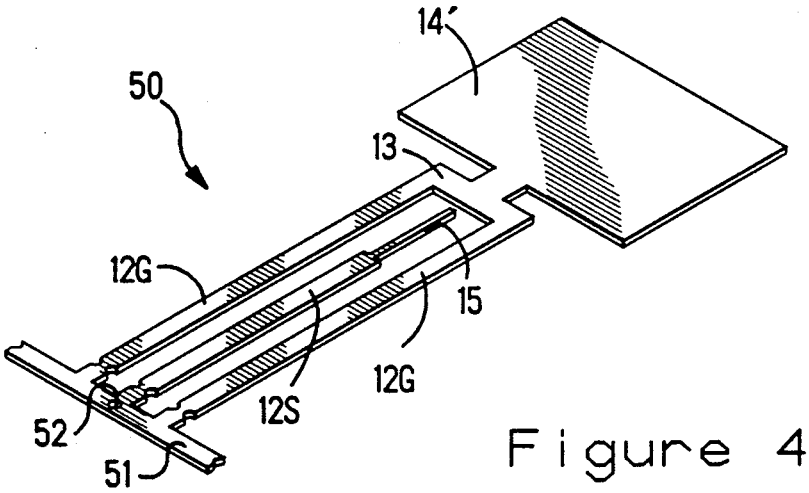
FIGS. 4A–E are perspective views showing alternative procedures involved in manufacturing the high-frequency connector of the present invention.
Figure 4B:
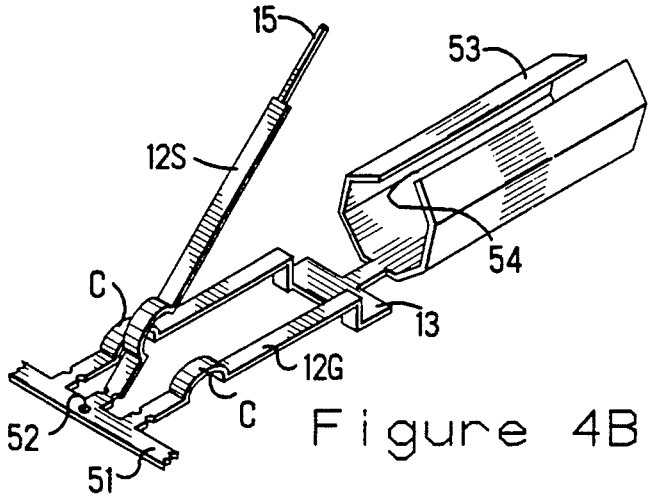
Figure 4C:
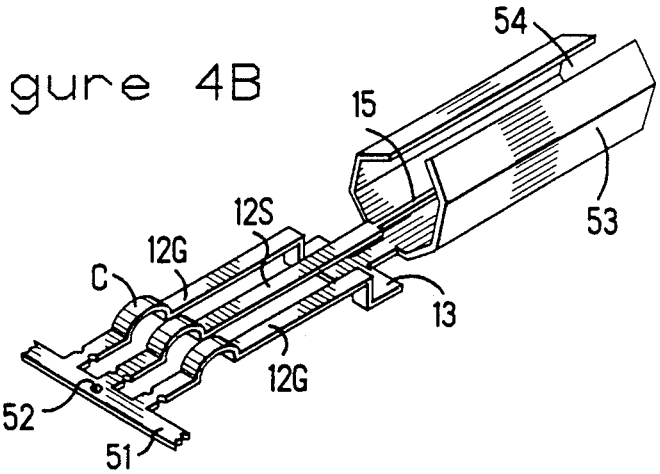

In FIG. 4A, multiple blanks 50 each of which include plated-shaped contacts 12G, 12S, a coupling part 13 of the ground contacts 12G and plate section 14' are fixed to carrier strip 51. This carrier strip 51 is equipped with feed holes 52 at specific intervals. Next, in FIG. 4B, contact sections C are formed on individual plate-shaped contacts 12 and at the same time, the front ends of plate-shaped ground contacts 12G and coupling part 13 are folded, plate section 14' is formed into a cylindrical shape and receptacle 53 is formed. This receptacle 53 should be polygonal when seen in cross-section and should be equipped with a slot 54 along the top part. At this time, plate-shaped signal contact 12S is bent upwardly from the place where it joins with carrier strip 51 and forming operations for receptacle 53 and coupling part 13 is carried out without difficulty. Then, the plate-shaped signal contact 12S is returned, as shown in FIG. 4C, with pin 15 passing through slot 54 so that pin 15 is positioned at the center of cylindrical receptacle 53.

Figure 4D:
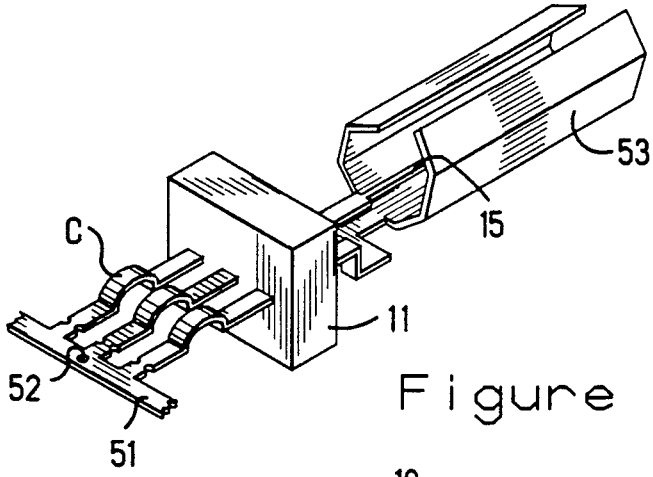
Figure 4E:
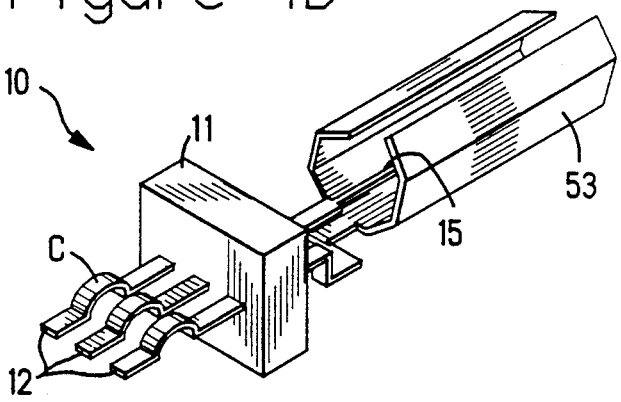

Next, the front ends of plate-shaped contacts 12 are fixed by dielectric block 11 by insert molding or by other means as shown in FIG. 4D. Last, the other end of each of the plate-shaped contacts 12 is disconnected from carrier strip 51 as shown in FIG. 4E. The high-frequency connector 10 manufactured in this way is manufactured in basically the same way as described previously. In a suitable practical example, the maximum dimension of dielectric block 11 is approximately 4 mm, the width of plate-shaped contact 12 is approximately 0.9 mm and the pitch of the adjoining blanks 50 is approximately 10 mm thus multiple small-scale connectors can be manufactured in a high-density fashion.

Figure 5:
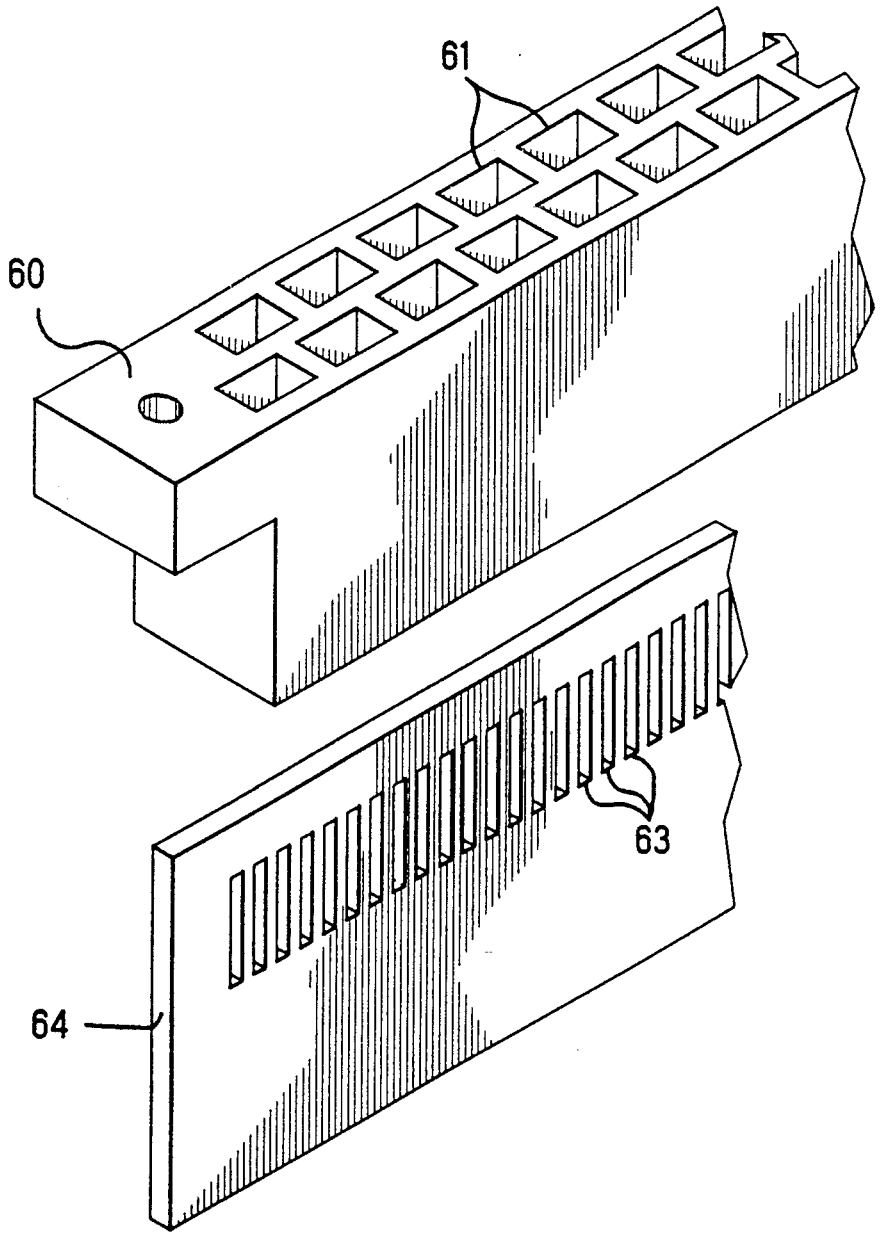
FIG. 5 is a part perspective view showing a modular-type high-frequency connector which makes use of a great number of the high-frequency connectors of the present invention.

FIG. 5 is a perspective view of the main parts of an example of the modular high-frequency connector device used to obtain multiple high-frequency connector assembled bodies using multiple high-frequency connectors 10 of the present invention. When this high-frequency connector device is used, multiple slots 61 are made to form two rows at specific intervals in insulated housing 60 and each of the high-frequency connectors 10 is inserted in these slots and retained there. Each of the slots 61 may have dimensions which correspond to dielectric block 11 and may be formed in a zigzag or staggered fashion for each line. The high-frequency connectors 10 which are inserted in these slots 61 are disposed so that contact parts C face each other. The bottom surface of insulated housing 60 (not shown) is equipped with a long, narrow substrate acceptance slot which corresponds to the spaces between the slot 61 rows and the multiple contact pads 63 of circuit substrate 62 formed on both end surfaces inside these slots. In this case, the coaxial connector 20 shown in FIG. 2 is inserted in the coaxial receptacle inside each of the slots 61 from the upper surface of insulated housing 60. A circuit substrate slot is formed on the upper surface of housing 60 if necessary and can be modified so that coaxial connector 20 is connected from the bottom surface side.

The high-frequency connector of the present invention has been described as well as the method for manufacturing it and the applied examples in light of suitable practical examples. It should be apparent that the present invention is by no means restricted to these practical examples and that a variety of changes and modifications are possible. For example, the plate-shaped contacts 12 by no means need be electric contact points which are equipped with contact sections. Depending on the use, it may be a contact which is soldered and connected to a circuit substrate and other conductors or it may be inserted in a through-hole and connected. Dielectric block 11 may be equipped with an opening and plate-shaped contacts 12 inserted therethrough and an adhesive material is used if necessary or they may be secured in place by welding.

The high-frequency connector of the present invention provides an ultra small-scale electrical connector which is equipped with a coaxial receptacle part and a coplanar transmission line part and which basically has no discontinuous points along the entire length and which has specific characteristic impedance. As a result, it is especially suitable for use with a modular structure for a high-performance IC test or which must transfer a great number of wideband signals with minimum distortion.

If the method for manufacturing the high-frequency connector of the present invention is used, connectors can be manufactured continuously and automatically as described above so that these connectors are not only smaller than the conventional coaxial connectors, but manufacturing costs can be significantly reduced as well.

We claim:

1. An electrical connector, comprising:

outer plate-shaped contacts and a center plate-shaped contact;

a dielectric member secured onto said plate-shaped contacts maintaining said plate-shaped contacts in spaced relationship and in the same plane so that the plate-shaped contacts are coplanar;

a coupling part at the other ends of the outer plate-shaped contacts interconnecting the outer plate-shaped contacts;

a receptacle contact member as part of said coupling part; and a pin contact member at the other end of said center plate-shaped contact disposed with said receptacle contact member at the center thereof.

2. An electrical connector as claimed in claim 1, wherein the other ends of the outer plate-shaped contacts are bent substantially at a right angle and said coupling part is bent substantially at a right angle with respect to the bent other ends so that said coupling part is spaced from the other end of the center plate-shaped contact and extends at a right angle thereto.

3. An electrical connector as claimed in claim 1, wherein the one end of the plate-shaped contacts have arcuate-shaped contact sections.

4. A method of manufacturing electrical connectors, comprising the steps of:

forming a series of ground contact assemblies extending outwardly at spaced intervals from a carrier strip with each of the ground contact assemblies including spaced plate-shaped ground contacts connected to the carrier strip at one end and coupled together by a coupling part at the other end, coupling part including a receptacle contact;

forming a series of signal contact assemblies extending outwardly at spaced intervals from another carrier strip with each of the signal contact assemblies being a plate-shaped signal contact connected to the other carrier strip at one end and defining a pin contact at the other end;

placing the other carrier strip onto the first-mentioned carrier strip so that the plate-shaped signal contacts are positioned between the spaced plate-shaped ground contacts and the pin contacts are disposed with the receptacle contacts thereby forming electrical connectors; and securing dielectric blocks onto the spaced plate-shaped ground contacts and plate-shaped signal contacts of the electrical connectors so that the plate-shaped contacts are coplanar and the receptacle contacts with the pin contacts therein are coaxial.

5. A method as claimed in claim 4, comprising the further step of bending the other ends of the ground contacts and the coupling part so that the coupling part is disposed in a plane parallel to the plane of the ground contacts.

6. A method of manufacturing electrical connectors, comprising the steps of:

forming a series of metal blanks extending outwardly at spaced intervals from a carrier strip with each metal blank including spaced plate-shaped ground contacts connected to the carrier strip at one end and coupled together by a coupling part at the other end, a plate section extending outwardly from the coupling part, and a plate-shaped signal contact between said plate-shaped ground contacts with one end connected to the carrier strip and the other end having a pin contact;

bending the signal contact so as to be spaced away from the ground contacts;

forming the plate section into a cylindrical receptacle contact;

positioning the signal contact in alignment with the ground contacts with the pin contact being disposed centrally within the receptacle contact thereby forming electrical connectors; and securing dielectric blocks onto the plate-shaped ground contacts and the plate-shaped signal contacts of the electrical connectors so that the plate-shaped contacts are coplanar and the receptacle contacts with the pin contacts therein are coaxial.

7. A method as claim in claim 6, comprising the additional steps of bending the other ends of the ground contacts and the coupling part so that the coupling part is disposed in a plane parallel to the plane of the ground contacts.

8. A method as claim in claim 6, comprising the further step of providing a slot in said receptacle contact so that said pin contact can pass therethrough when the signal contact is positioned in alignment with the ground contacts.

* * * * *